US007986280B2

(12) United States Patent
Semonov

(10) Patent No.: US 7,986,280 B2
(45) Date of Patent: Jul. 26, 2011

(54) MULTI-ELEMENT BROADBAND OMNI-DIRECTIONAL ANTENNA ARRAY

(75) Inventor: Kostyantyn Semonov, Irvine, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 346 days.

(21) Appl. No.: 12/365,767

(22) Filed: Feb. 4, 2009

(65) Prior Publication Data

US 2009/0195471 A1 Aug. 6, 2009

Related U.S. Application Data

(60) Provisional application No. 61/026,675, filed on Feb. 6, 2008.

(51) Int. Cl.
*H01Q 9/28* (2006.01)
*H01Q 21/00* (2006.01)

(52) U.S. Cl. ..... 343/795; 343/810; 343/816; 343/820

(58) Field of Classification Search ..... 343/795, 343/810, 812, 813, 816, 820, 824, 850, 853, 343/857, 858, 700 MS
See application file for complete search history.

(56) References Cited

U.S. PATENT DOCUMENTS 6,067,053 A 5/2000 Runyon et al.
6,670,923 B1 12/2003 Kadambi et al.
6,741,219 B2 * 5/2004 Shor ..... 343/795
6,747,605 B2 * 6/2004 Lebaric et al. ..... 343/795
6,859,176 B2 * 2/2005 Choi ..... 343/700 MS
7,224,315 B2 * 5/2007 Tsai et al. ..... 343/700 MS
7,274,339 B2 * 9/2007 Wu et al. ..... 343/795
7,764,245 B2 * 7/2010 Loyet ..... 343/795
2004/0061652 A1 4/2004 Ishihara et al.
2004/0125031 A1 7/2004 Jo et al.
2004/0207562 A1 10/2004 Schadler
2006/0232492 A1 10/2006 Sawatani
2006/0290573 A1 12/2006 Puente Baliarda et al.
2009/0079653 A1 3/2009 Semonov et al.
2009/0096698 A1 4/2009 Semonov et al.

* cited by examiner

*Primary Examiner* — Hoang V Nguyen
(74) *Attorney, Agent, or Firm* — OC Patent Law Group

(57) ABSTRACT

A broad beam width antenna array, preferably having 360 degrees of azimuth coverage, which also has broad frequency bandwidth, for use in a wireless network system is disclosed. In a preferred embodiment the antenna array comprises a planar dielectric substrate, micro strip elements on both sides of the dielectric substrate, and a corporate feed structure employing parasitic conductive beam width enhancing tubes as feed line conduits. The antenna array comprises dipole radiating elements formed on both sides of the dielectric substrate and a balanced feed network feeding each dipole arm. The shape of the dipole is symmetric and the overall structure, including feed network, preferably has a ⌈-shape when viewed from either side of the dielectric substrate. Disposed proximate to each dipole arm are bandwidth enhancement coplanar micro strips which are parallel to each dipole arm and at least partially overlapping each other.

20 Claims, 5 Drawing Sheets

MULTI-ELEMENT BROADBAND OMNI-DIRECTIONAL ANTENNA ARRAY

RELATED APPLICATION INFORMATION

The present application claims the benefit under 35 USC 119(e) of provisional patent application 61/026,675 filed Feb. 6, 2008, the disclosure of which is incorporated herein by reference in its entirety.

BACKGROUND OF THE INVENTION

1. Field of the Invention

The present invention relates in general to radio communication systems and components, and related methods. More particularly the present invention is directed to antenna arrays for wireless communication networks.

2. Description of the Prior Art and Related Background Information

Modern wireless antenna implementations generally include a plurality of radiating elements that may be arranged to provide a desired radiated (and received) signal beamwidth and azimuth scan angle. For an omni-directional antenna it is desirable to achieve a near uniform beamwidth that exhibits a minimum variation over 360 degrees of coverage. Differing from highly directional antennas an omni-directional antenna beamwidth is preferably near constant in azimuth. Such antennas provide equal signal coverage about them which is useful in certain wireless applications.

Consequently, there is a need for an antenna array having wide operating bandwidth while providing 360 degrees of azimuth coverage.

SUMMARY OF THE INVENTION

In a first aspect the present invention provides an antenna array comprising a planar dielectric substrate, an array of radiating elements configured on the substrate, the radiating elements arranged in pairs forming two columns, and an elongated hollow conductive element spaced apart from the substrate configured in front of the array of radiating elements. The elongated hollow conductive element has an opening adjacent an interior portion of the array and an RF feed line is configured in the elongated hollow conductive element, extending out of the opening in the conductive element to couple to and feed an RF signal to the array of radiating elements at an interior portion of the array of radiating elements.

In a preferred embodiment of the antenna array the RF feed line comprises a coaxial cable. The elongated hollow conductive element may comprise a conductive tube. The array of radiating elements is preferably configured on both sides of the substrate and the antenna array further comprises a second elongated hollow conductive element, configured in front of the array of radiating elements on the opposite side of the substrate from the other elongated hollow conductive element and having an opening adjacent an interior portion of the array on the opposite side of the substrate, and a second RF feed line configured in the second elongated hollow conductive element and extending out of the opening in the second conductive element to couple to and feed an RF signal to the array of radiating elements from the opposite side of the substrate. The array of radiating elements preferably comprises an array of microstrip dipole radiating elements on both sides of the dielectric substrate, each microstrip dipole radiating element comprising first and second dipole arms. The micro strip dipole radiating elements are preferably symmetrically configured in pairs on opposite sides of a centerline of the dielectric substrate. Each of the dipole radiating elements preferably includes a micro strip feed network, wherein the shape of each of the dipole radiating elements, including the feed network, has a ⌈-shape when viewed from either side of the dielectric substrate. Bandwidth enhancement, partially overlapping micro strip elements are preferably configured proximate to each of the micro strip dipole radiating element dipole arms. The array of radiating elements preferably includes two or more sub arrays each having two or more pairs of radiating elements.

In another aspect the present invention provides a broad bandwidth omni-directional antenna array comprising a substrate, a plurality of radiating elements configured in an array in plural pairs forming two columns and comprising symmetrically arranged micro strip elements on both sides of the substrate, and a symmetrically configured feed structure coupled to provide RF signals to the radiating elements. The antenna array further comprises first and second hollow conductive elements configured on opposite sides of the substrate, each having an opening and first and second RF feed lines configured within the hollow conductive elements and extending out of the openings in the elements to couple to the feed structure on opposite sides of the substrate.

In a preferred embodiment of the antenna array the hollow conductive elements are configured relative to the substrate and radiating elements to provide parasitic coupling to the antenna beam thereby expanding the beam pattern of the array to form a substantially omni-directional beam pattern. The feed structure is coupled to the feed lines to provide a corporate feed to the array at first and second coupling ports. The feed structure may further couple additional plural radiating elements in a series feed arrangement fed from the coupling ports. The series feed arrangement may comprise a micro strip line coupling to the radiating elements.

In another aspect the present invention provides an antenna array comprising a substrate, a first sub group of radiating elements configured on the substrate in an array comprising two or more pairs of symmetrically arranged radiating elements, and a first feed port configured on the substrate coupled to symmetrically feed the two pairs of radiating elements from a central location inside the two or more pairs of symmetrically arranged radiating elements. The antenna array further comprises a second sub group of radiating elements configured on the substrate in an array comprising two or more pairs of symmetrically arranged radiating elements and a second feed port configured on the substrate coupled to symmetrically feed the two pairs of radiating elements from a central location inside the two or more pairs of symmetrically arranged radiating elements. The antenna array further comprises a first hollow conductive parasitic beam pattern augmentation element spaced apart from the substrate adjacent the first sub group of radiating elements, a first feed line configured partially within the first hollow conductive parasitic beam pattern augmentation element and extending out of the element and coupling to the first feed port, a second hollow conductive parasitic beam pattern augmentation element spaced apart from the substrate adjacent the second sub group of radiating elements, and a second feed line configured partially within the second hollow conductive parasitic beam pattern augmentation element and extending out of the element and coupling to the second feed port.

In a preferred embodiment of the antenna array the antenna array further comprises a common RF input port coupled to the first and second feed lines by an input signal divider network. The second feed line is approximately $4\lambda$ longer than first feed line where $\lambda$ corresponds to the wavelength of the RF signal applied to the common RF input port. The first and second feed ports further function as equal power, in-phase signal dividers to feed first and second pairs of radiating elements comprising each of the first and second sub group of radiating elements. The first and second hollow conductive parasitic beam pattern augmentation elements both extend substantially the entire length of both of the sub groups of radiating elements. The first and second feed lines preferably comprise coaxial cables.

Further features and advantages of the present invention will be appreciated from the following detailed description of the invention.

DETAILED DESCRIPTION OF THE INVENTION

Figure 1A:
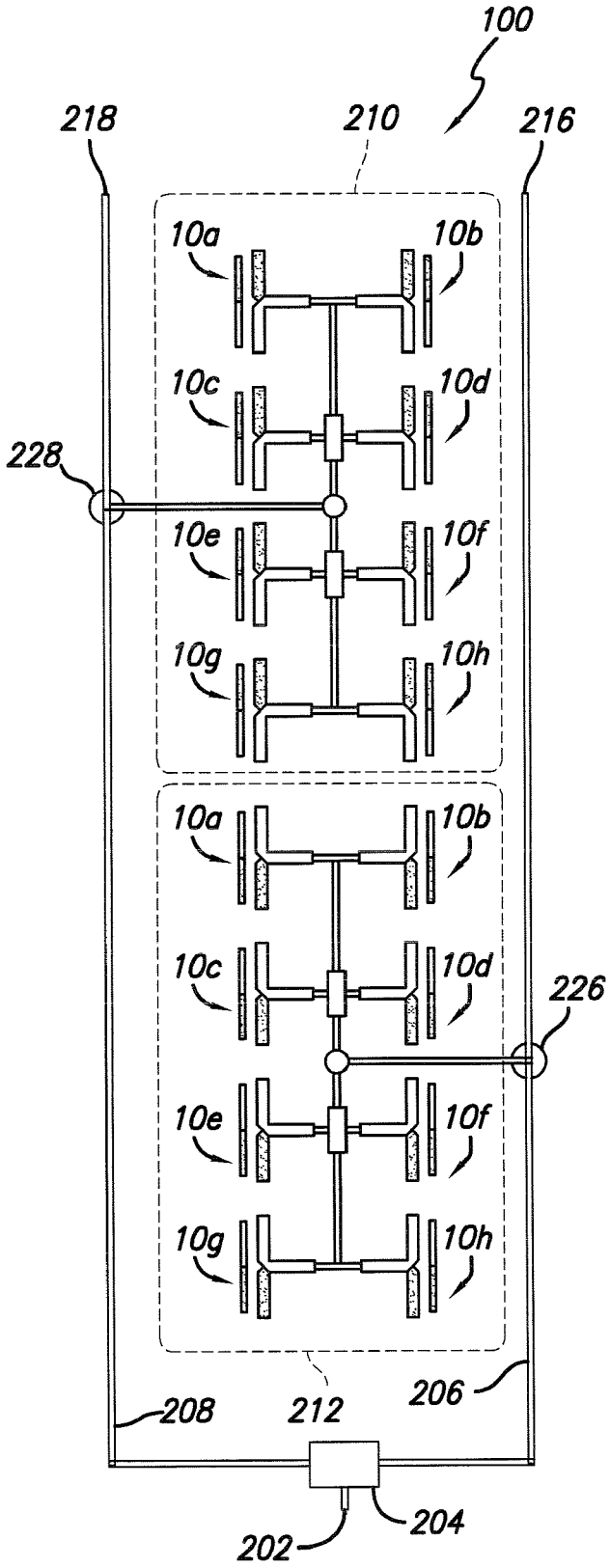
FIGS. 1A and 1B provide layout and electrical interconnect diagrams for an omni-directional antenna array in accordance with a preferred embodiment of the invention.

One object of the present invention is to provide a broad beam width antenna, preferably having 360 degrees of azimuth coverage, for use in a wireless network system. Another object of the present invention is to provide a dielectric based coplanar antenna element which has broad frequency bandwidth, is easy to fabricate using conventional PCB processes, and has a low profile.

In a preferred embodiment the antenna array comprises a planar dielectric substrate, micro strip elements on both sides of the dielectric substrate, and a corporate feed structure employing parasitic conductive beam width enhancing tubes as feed line conduits. In one preferred embodiment, the antenna array comprises dipole radiating elements formed on both sides of the dielectric substrate and a balanced feed network feeding each dipole arm. The shape of the dipole is symmetric and the overall structure, including feed network, has a ⌈-shape when viewed from either side of the dielectric substrate. Disposed proximate to each dipole arm are bandwidth enhancement coplanar micro strips which are parallel to each dipole arm and at least partially overlapping each other.

Reference will be made to the accompanying drawings, which assist in illustrating the various pertinent features of the present invention. In certain instances herein chosen for illustrating the invention, certain terminology is used which will be recognized as being employed for convenience and having no limiting significance. For example, the terms "horizontal", "vertical", "upper", "lower", "bottom" and "top" refer to the illustrated embodiment in its normal position of use. Some of the components represented in the drawings are not necessarily to scale, emphasis instead being placed upon clearly illustrating the principles of the present invention.

FIG. 1A presents a front view of an antenna array 100 which utilizes a pair of octonary omni-directional radiating element sub-groups 210, 212 preferably constructed on a single piece of dielectric material. The following description refers to an antenna used in conjunction with a transmitter supplying Radio Frequency (RF) signals to be transmitted by an antenna array. However, it shall be understood that an antenna array can be used for signal reception as well in conjunction with a suitable receiver. Radiating elements 10(*a-h*) may be of any suitable construction employing a method which prints or attached metal conductors directly on a top 12*a* and bottom 12*b* sides of a dielectric substrate 12, such as PCB (printed circuit board) processing. The square dielectric plane 12 is dimensioned to fit all necessary conductors in a manner which is not only compact but which provides radiation pattern, frequency response and bandwidth over the desired frequency of operation. In this embodiment the desired radio frequency (RF) is approximately 3.30 GHz to 3.80 GHz and disposed antenna elements 10(*a-h*) and associated feed networks 50-58 are preferably constructed utilizing commercially available PCB material manufactured by Taconic RF-35, $\in_r$=3.5 and thickness=30 mills. Other well known operational RF frequencies may also be employed. Alternative dielectric substrates (PCB materials) 12 are possible provided that properties of such substrate be chosen in a manner to be compatible with commonly available PCB processes. Alternatively metal conductor attachment to alternative dielectric substrates can be achieved through various means known to the skilled in the art. Further details relating to a preferred radiating element structure are disclosed in co-pending application Ser. No. 12/212,533 filed Sep. 17, 2008 and provisional application Ser. No. 60/994,557 filed Sep. 20, 2007, the disclosures of which are incorporated herein fully by reference.

Preferably adjacent radiating element pairs (10*a* & 10*b*) to (10*g* & 10*h*) are vertically spaced from each other at 1 electrical (1λ) wavelength which is directly dependent on the dielectric properties of the dielectric substrate 12. Adjacent elements (10*g* & and 10*h*) and (10*a* & 10*b*) of adjacent radiating element sub-group 210, 212 are also spaced at 1 electrical (1λ) wavelength. Non-uniform radiating element pairs spacing is possible, however such configuration may affect elevation radiation pattern uniformity or may result in unwanted elevation side lobes.

Figure 1B:
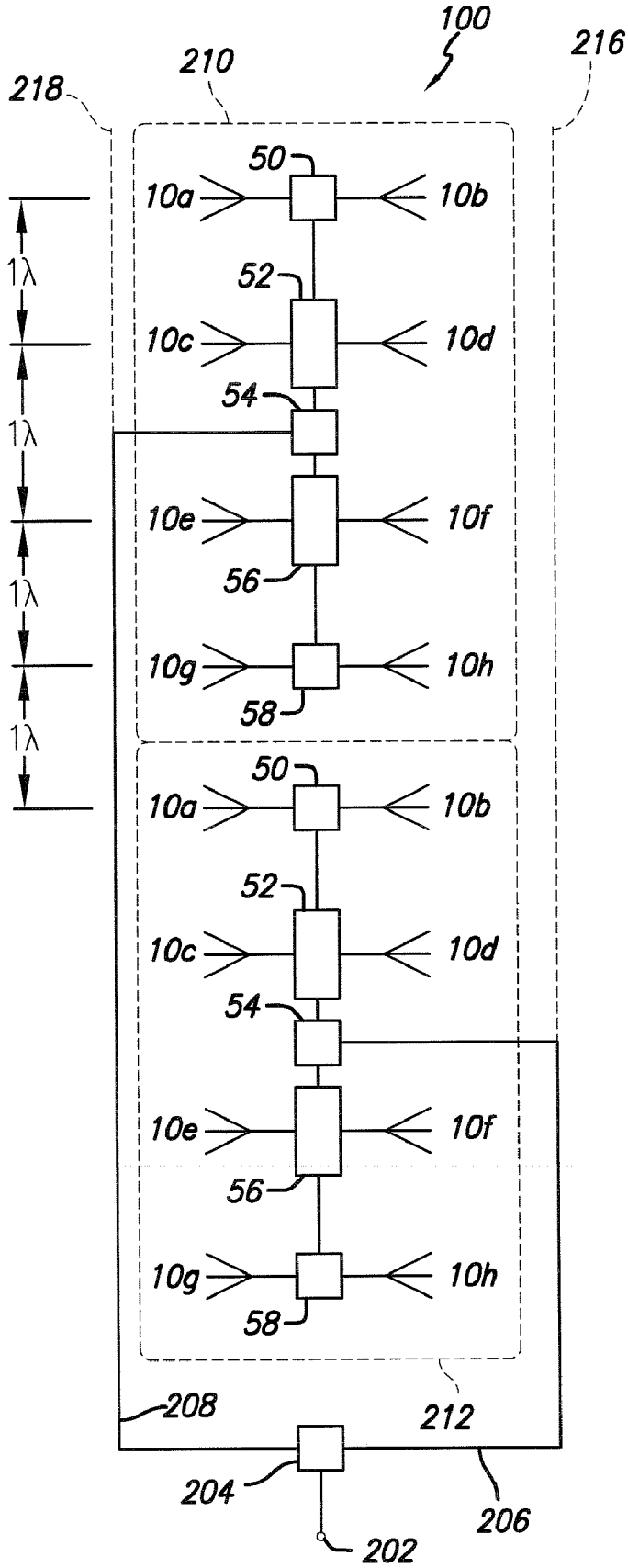
Figure 2:
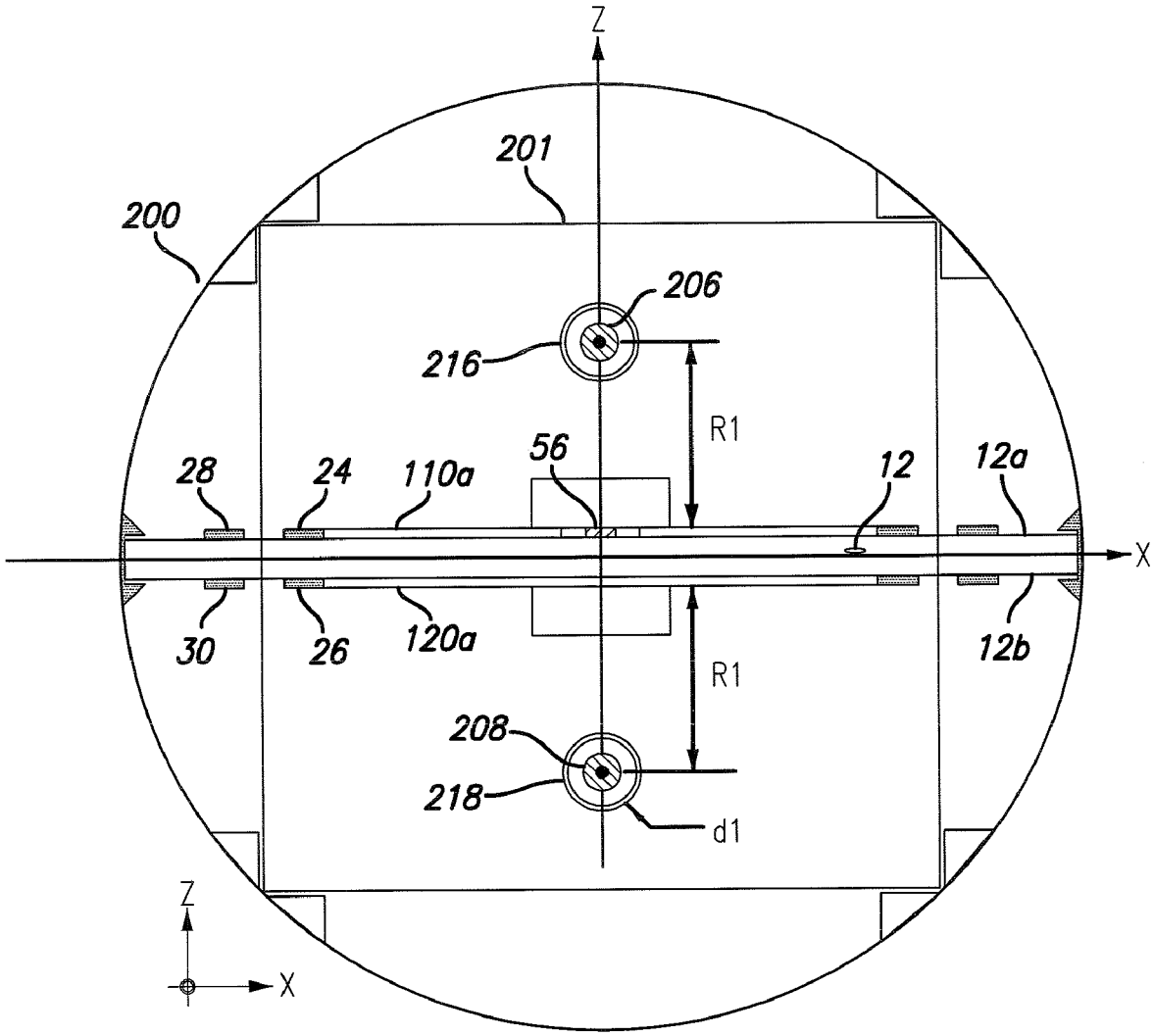
FIG. 2 is a cross section end view of the antenna array configured inside a radome used to enclose the omni-directional antenna array in accordance with a preferred embodiment of the present invention.

As shown, FIG. 1A and FIG. 1B octonary (8 element) omni-directional radiating element sub-group 210, 212 is center fed at a common port 54 which also acts as equal power, in-phase signal divider (−3 dB). Common port 54 may be implemented as a micro strip structure which converts the unbalanced signal from the input feed line to a symmetrical balanced feed structure on the array. Input RF signals supplied by a transmitter (not shown) to antenna system 100 are coupled to a common port 202 which provides equal 204 signal division (−3 dB) (or combining when signals are received by an antenna array from a distant transmitter) to each radiating element sub-group 210, 212. Output ports of equal signal divider 204 are coupled to first 206 and second 208 RF feed lines, for example coaxial cables. Respectively, first 206 and second 208 RF feed lines couple input signals to first 212 and second 210 radiating element sub-group. The two coaxial cables 206, 208 are enclosed within pattern augmentation hollow rods 216, 218 for a portion of the length of the overall antenna 100 array length. Although these are shown in FIG. 1A and 1B as running along the sides of the array this is purely for ease of illustration as the feed lines and rods 216, 218 and feed lines 206, 208 are configured in front of the array on opposite sides thereof (as best shown in FIG. 2). Pattern augmentation hollow rods 216, 218 traverse the full length of antenna 100 array assembly.

As will be appreciated by those skilled in the art, the coupling of the feed lines 206, 208 to the interior of the sub groups (or sub arrays) 210, 212 provides a corporate feed with attendant advantages including a wide bandwidth capability for the array. As shown in FIG. 1A and 1B, the outer radiating elements in each sub array, elements 10*a*, 10*b* and 10*g*, 10*h*, may be coupled via a series feed using a micro strip line coupling 50-52, 56-58 (described in more detail below).

This thus provides a hybrid corporate and series feed arrangement for the array. This may have space and/or cost advantages in some applications. However, a purely corporate feed may also be provided with additional feed lines in each of the hollow rods 216, 218 with openings at selected locations to feed the other radiating elements. Also, additional rods may be provided which may have separate feed lines therein. Also, the number of radiating elements shown and the grouping into two sub groups 210, 212 is only one implementation and fewer or greater numbers of radiating elements and/or groups may be provided.

Figure 3:
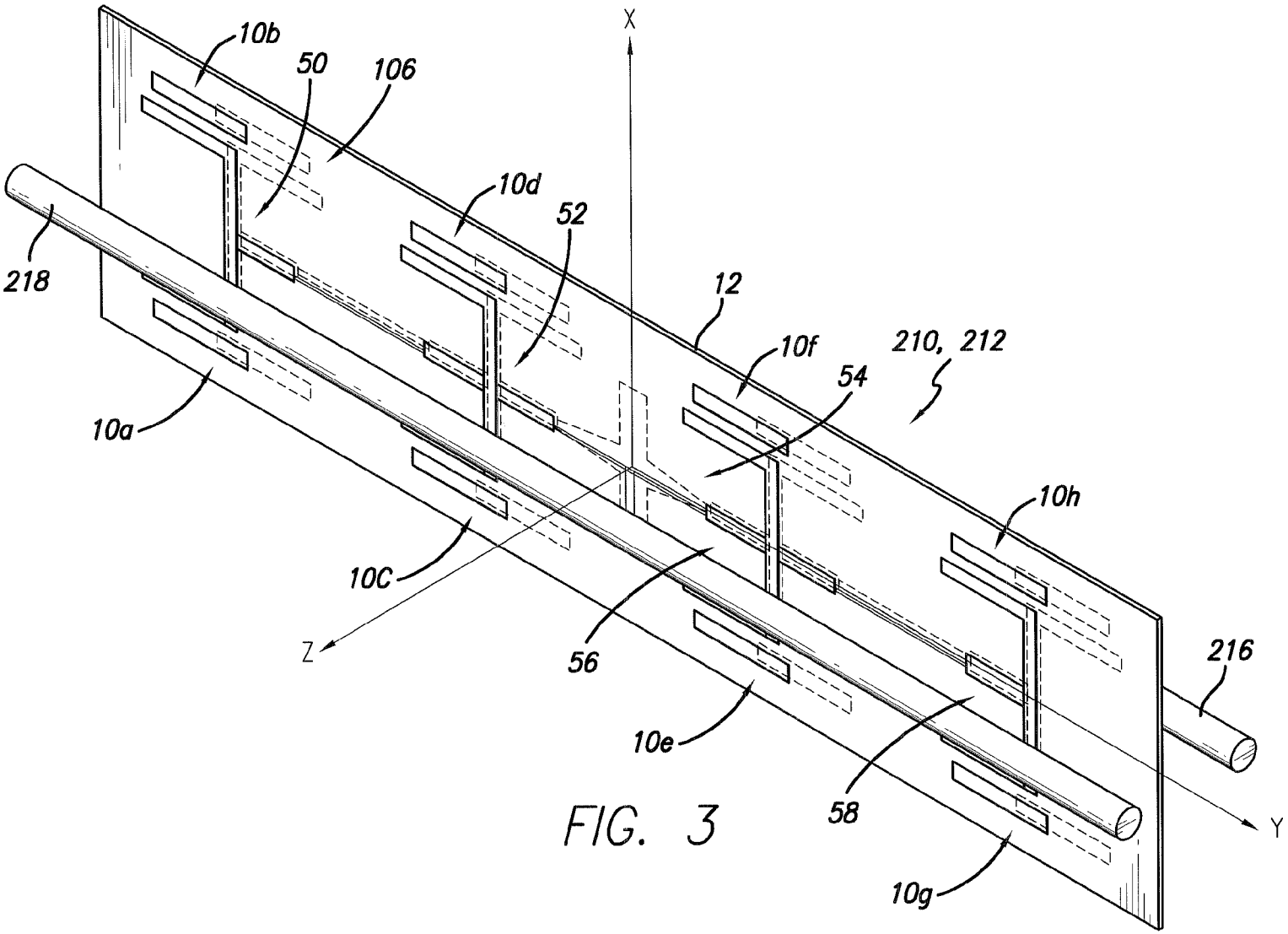
FIG. 3 is an isometric perspective view of an octonary radiating element sub-group in accordance with a preferred embodiment of the invention.

In FIG. 2 an end view of the array is shown configured inside a radome. FIG. 3 is an isometric view of one array sub group 210 (or 212) in accordance with a preferred embodiment of the invention as described above. As best shown in FIG. 2, pattern augmentation rods 216, 218 have outside diameter d1 and are symmetrically spaced a distance R1 from the array substrate 12, oriented along a longitudinal centerline of the element sub-group 210, 212. Pattern augmentation rods 216, 218 are conductive and provide a parasitic enhancement of azimuth beam width. Suitable construction of such rods or tubes are described in more detail in copending application Ser. No. 12/287,661 filed Oct. 10, 2008, the disclosure of which is incorporated herein by reference in its entirety. As mentioned above additional rods may also be provided and an example with four rods is shown in the above noted '661 application incorporated by reference herein. Cross-sectional dielectric braces 201 (one is shown, but several can be used, for example one at the top and one at the bottom of the array) are used to establish and maintain rod (216, 218) spacing relative to dielectric material 12 as well as to allow ease of assembly during installation into a suitably constructed radome 200. These braces 201 can be omitted provided that rods (216, 218) are rigid enough to maintain desired distance from the surface of the dielectric (12*a*, 12*b*) or alternatively replaced with similar structures, for example plastic clips, that serve essentially the same mechanical support purpose without distorting antenna array radiation pattern. Additional features of the strip line configuration on the substrate are also illustrated. Specifically, 24 shows a top side dipole arm micro strip; 26 shows a bottom side dipole arm; 28 shows a top side beam width and pattern augmentation micro strip; 30 shows a top side pattern augmentation micro strip; 110*a* shows a top side balanced feed; and 120*a* shows a bottom side balanced feed micro strip.

Coaxial cables 206, 208 are routed to a traverse position which is directly above and orthogonal of octonary input divider 54 input port of the respective radiating element sub-group 210, 212. Hereinafter, coaxial cables 206, 208 are lunched through an opening 226, 228 in the pattern augmentation hollow rods 216, 218 toward respective input divider 54 input port. Coaxial cables 206, 208 can be coupled to input dividers 54 using ordinary means known in the art. Second coaxial cable 208 is preferably approximately 4λ wavelengths longer than first coaxial cable 206. The length difference is dictated by having first 210 antenna sub-group and second 210 antenna sub-group fed in phase.

In reference to FIG. 1B octonary omni-directional radiating element sub-group 210, 212 signal distribution network will now be described. Coaxial cables 206, 208 couple a portion of input RF signals to respective input divider 54 input ports. Input divider 54 has two equal power (−3 dB), in-phase output ports, for example a Wilkinson divider. The upper output port of the input divider 54 is coupled to input port of the first inline 52 unequal 3-way divider-transformer network. Similarly, lower output port of the input divider 54 is coupled to input port of the second inline 56 unequal divider-transformer network. The first 52 and second 56 unequal divider-transformer networks utilize identical topology and construction techniques. For uniform signal distribution among radiating elements unequal divider network (52, 56) provides −6 dB signal coupling to the two equal power, in-phase phase output ports and −3 dB signal to the upper (or lower) output port.

Inline, first 52 unequal divider-transformer network has three output ports. The two (−6 dB) output ports are coupled to radiating elements 10*c* and 10*d*, and have identical coupling value whereas the third port (−3 dB) is coupled to the input port of the second (50) equal power, in-phase divider network. Similarly, lower output port of the second unequal divider 56 is coupled to the input port of the third 58 equal power divider network and equal power (−6 dB) output ports are coupled to radiating elements 10*e* and 10*f*. The second 50 and third 58 equal divider networks utilize identical topology and construction techniques. For that reason output ports of the above mentioned second 50 and third 58 equal power (−3 dB), in-phase divider networks are coupled to radiating elements 10*a* & 10*b* and 10*g* & 10*h*, respectively.

It will be apparent to skilled artisans that antenna structure 100 may include additional number of radiating element sub-groups 210, 212 (two or more) in accordance with the present invention directives to augment the radiation pattern as desired. Alternatively, radiating element spacing between adjacent radiating element pairs (10*a* & 10*b* and 10*c* & 10*d*) may be changed to other than 1 electrical (1λ) wavelength or fraction thereof to attain the desired radiation pattern.

Figure 4:
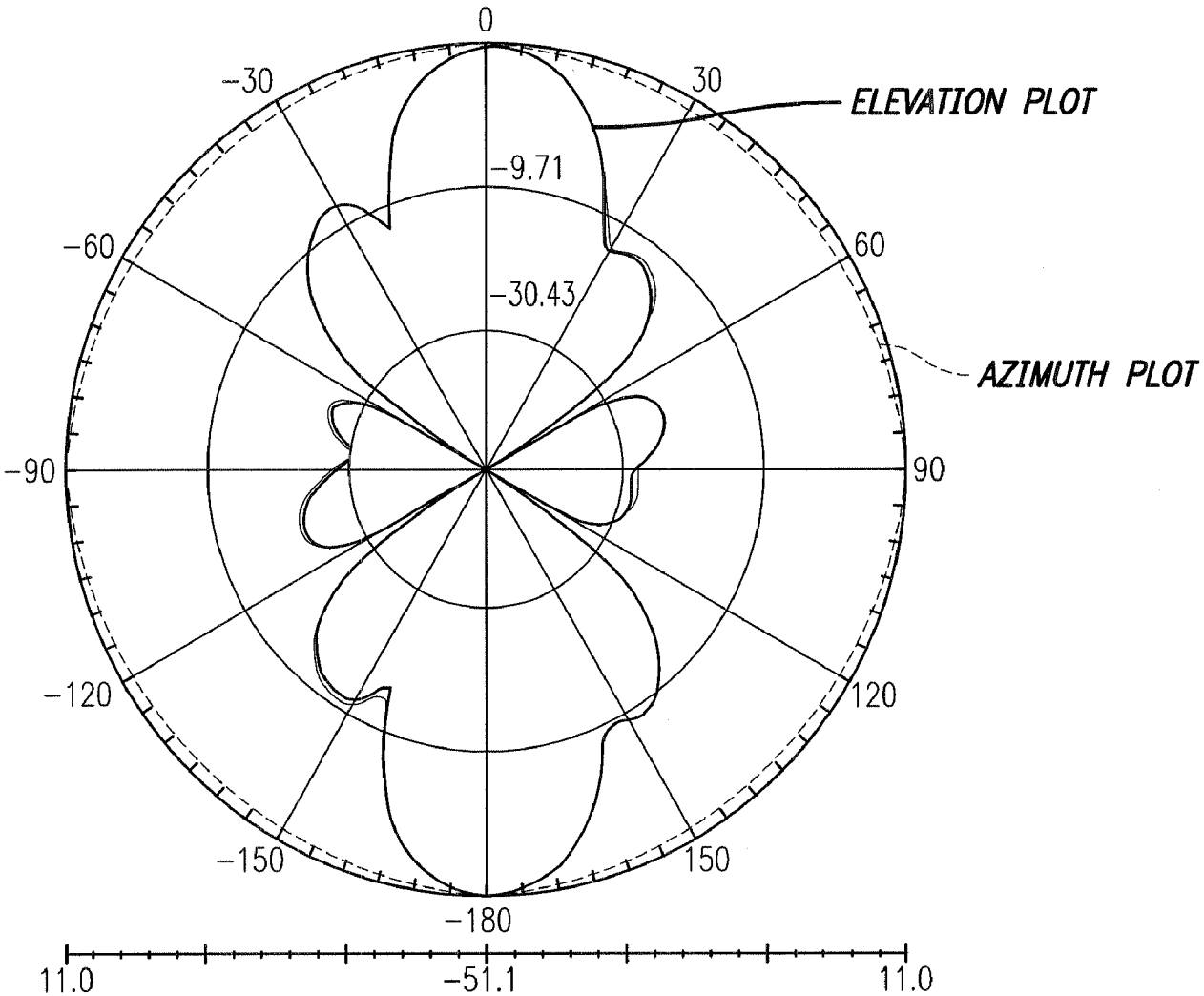
FIG. 4 illustrates a simulated azimuth and elevation radiation pattern for an octonary radiating element sub-group in accordance with a preferred embodiment of the invention.

FIG. 4 illustrates a simulated azimuth and elevation radiation pattern for an octonary radiating element sub-group in accordance with a preferred embodiment of the invention. It will be appreciated from the azimuth plot that an omni directional azimuth beam pattern is provided.

The present invention has been described primarily in relation to specific preferred embodiments. The description is not intended to limit the invention to the form disclosed herein. Accordingly, variants and modifications consistent with the foregoing teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

REFERENCE DESIGNATOR DESCRIPTION

10(*a-h*) Radiating element
12 Planar dielectric material body
12*a* Top side of the dielectric material body
12*b* Bottom side of the dielectric material body
24 Top side dipole arm
26 Bottom side dipole arm
28 Top side pattern augmentation microstrip
30 Top side pattern augmentation microstrip
50 Second equal power, in-phase divider network
52 First inline unequal 3-way divider-transformer network
54 Common input port which also acts as equal power, in-phase signal divider (−3 dB).

56 Second inline unequal 3-way divider-transformer network.
58 Third equal power, in-phase divider network
110*a* Top side balanced feed
120*a* Bottom side balanced feed
200 Antenna Radome
201 Cross sectional dielectric braces
202 Common input port
204 Input signal divider network
206 First RF feed line
208 Second RF feed line
210 First omni directional radiating element sub-group
212 Second omni directional radiating element sub-group
216 Top side radiation pattern augmentation rod
218 Bottom side radiation pattern augmentation rod
226 An opening in the top side radiation pattern augmentation rod for traversing coaxial cable (216) between the confines of the rod to the common input port (54)
228 An opening in the bottom side radiation pattern augmentation rod for traversing coaxial cable (218) between the confines of the rod to the common input port (54)

What is claimed is:

1. An antenna array, comprising:
a planar dielectric substrate;
an array of radiating elements configured on said substrate, said radiating elements arranged in pairs forming two columns;
an elongated hollow conductive element spaced apart from said substrate configured in front of the array of radiating elements, said elongated hollow conductive element having an opening adjacent an interior portion of the array; and
an RF feed line configured in said elongated hollow conductive element and extending out of the opening in said conductive element to couple to and feed an RF signal to said array of radiating elements at an interior portion of the array of radiating elements.

2. An antenna array as set out in claim 1, wherein said RF feed line comprises a coaxial cable.

3. An antenna array as set out in claim 1, wherein said elongated hollow conductive element comprises a conductive tube.

4. An antenna array as set out in claim 1, wherein said array of radiating elements is configured on both sides of said substrate and wherein said antenna array further comprises a second elongated hollow conductive element, configured in front of the array of radiating elements on the opposite side of the substrate from the other elongated hollow conductive element and having an opening adjacent an interior portion of the array on said opposite side of the substrate, and a second RF feed line configured in said second elongated hollow conductive element and extending out of the opening in said second conductive element to couple to and feed an RF signal to said array of radiating elements from said opposite side of the substrate.

5. An antenna array as set out in claim 4, wherein said array of radiating elements comprises an array of micro strip dipole radiating elements on both sides of the dielectric substrate, each micro strip dipole radiating element comprising first and second dipole arms.

6. An antenna array as set out in claim 5, further comprising bandwidth enhancement, partially overlapping micro strip elements proximate to each of said micro strip dipole radiating element dipole arms.

7. An antenna array as set out in claim 4, wherein said micro strip dipole radiating elements are symmetrically configured in pairs on opposite sides of a centerline of the dielectric substrate.

8. An antenna array as set out in claim 7, wherein each of the dipole radiating elements includes a micro strip feed network, wherein the shape of each of the dipole radiating elements, including the feed network, has a ⌈-shape when viewed from either side of the dielectric substrate.

9. An antenna array as set out in claim 1, wherein said array of radiating elements includes two or more sub arrays each having two or more pairs of radiating elements.

10. A broad bandwidth omni-directional antenna array, comprising:
a substrate;
a plurality of radiating elements configured in an array in plural pairs forming two columns and comprising symmetrically arranged micro strip elements on both sides of said substrate;
a symmetrically configured feed structure coupled to provide RF signals to said radiating elements;
first and second hollow conductive elements configured on opposite sides of said substrate, each having an opening; and
first and second RF feed lines configured within said hollow conductive elements and extending out of the openings in said elements to couple to said feed structure on opposite sides of said substrate.

11. An omni-directional antenna array as set out in claim 10, wherein said hollow conductive elements are configured relative to the substrate and radiating elements to provide parasitic coupling to the antenna beam thereby expanding the beam pattern of the array to form a substantially omni-directional beam pattern.

12. An omni-directional antenna array as set out in claim 10, wherein said feed structure is coupled to said feed lines to provide a corporate feed to the array at first and second coupling ports.

13. An omni-directional antenna array as set out in claim 12, wherein said feed structure further couples plural radiating elements in a series feed arrangement fed from said coupling ports.

14. An omni-directional antenna array as set out in claim 13, wherein said series feed arrangement comprises a micro strip line coupling to said radiating elements.

15. An antenna array, comprising:
a substrate;
a first sub group of radiating elements configured on the substrate in an array comprising two or more pairs of symmetrically arranged radiating elements;
a first feed port configured on the substrate coupled to symmetrically feed the two pairs of radiating elements from a central location inside the two or more pairs of symmetrically arranged radiating elements;
a second sub group of radiating elements configured on the substrate in an array comprising two or more pairs of symmetrically arranged radiating elements;
a second feed port configured on the substrate coupled to symmetrically feed the two pairs of radiating elements from a central location inside the two or more pairs of symmetrically arranged radiating elements;
a first hollow conductive parasitic beam pattern augmentation element spaced apart from the substrate adjacent the first sub group of radiating elements;

a first feed line configured partially within the first hollow conductive parasitic beam pattern augmentation element and extending out of the element and coupling to said first feed port;

a second hollow conductive parasitic beam pattern augmentation element spaced apart from the substrate adjacent the second sub group of radiating elements; and a second feed line configured partially within the second hollow conductive parasitic beam pattern augmentation element and extending out of the element and coupling to said second feed port.

16. An antenna array as set out in claim 15, further comprising a common RF input port coupled to said first and second feed lines by an input signal divider network.

17. An antenna array as set out in claim 16, wherein the second feed line is approximately 4λ longer than first feed line where λ corresponds to the wavelength of the RF signal applied to the common RF input port.

18. An antenna array as set out in claim 15, wherein said first and second feed ports further function as equal power, in-phase signal dividers to feed first and second pairs of radiating elements comprising each of said first and second sub group of radiating elements.

19. An antenna array as set out in claim 15, wherein said first and second hollow conductive parasitic beam pattern augmentation elements both extend substantially the entire length of both of the sub groups of radiating elements.

20. An antenna array as set out in claim 15, wherein said first and second feed lines comprise coaxial cables.

* * * * *